US010400504B2

(12) United States Patent
Boucher et al.

(10) Patent No.: US 10,400,504 B2
(45) Date of Patent: Sep. 3, 2019

(54) INSULATING GLAZED ELEMENT

(71) Applicant: AGC GLASS EUROPE, Louvain-la-Neuve (BE)

(72) Inventors: Nicolas Boucher, Brussels (BE); Pierre Schneider, Romagne (FR); Olivier Bouesnard, Ittre (BE); Jean-Philippe Biard, Frasnes-Lez-Gosselies (BE)

(73) Assignee: AGC GLASS EUROPE, Louvain-la-Neuve (BE)

( * ) Notice: Subject to any disclaimer, the term of this patent is extended or adjusted under 35 U.S.C. 154(b) by 0 days.

(21) Appl. No.: 15/124,313

(22) PCT Filed: Feb. 18, 2015

(86) PCT No.: PCT/EP2015/053370
§ 371 (c)(1),
(2) Date: Sep. 7, 2016

(87) PCT Pub. No.: WO2015/132071
PCT Pub. Date: Sep. 11, 2015

(65) Prior Publication Data

US 2017/0016271 A1 Jan. 19, 2017

(30) Foreign Application Priority Data

Mar. 7, 2014 (EP) ..... 14158278
Oct. 10, 2014 (EP) ..... 14188477

(51) Int. Cl.
*E06B 3/663* (2006.01)
*A47F 3/04* (2006.01)
(Continued)

(52) U.S. Cl.
CPC ..... *E06B 3/6715* (2013.01); *A47F 3/0434* (2013.01); *E06B 3/66328* (2013.01);
(Continued)

(58) Field of Classification Search
CPC ..... E06B 3/6715; E06B 3/66328; E06B 3/66333; E06B 3/66371; E06B 5/00; E06B 9/06; A47F 3/0434
See application file for complete search history.

(56) References Cited

U.S. PATENT DOCUMENTS 4,658,553 A 4/1987 Shinagawa
5,584,143 A 12/1996 Kennedy

FOREIGN PATENT DOCUMENTS

DE 30 48 763 A1 8/1982
DE 10 2011 009 879 A1 8/2012
(Continued)

OTHER PUBLICATIONS

International Search Report dated May 11, 2015 in PCT/EP15/053370 Filed Feb. 18, 2015.
(Continued)

*Primary Examiner* — Donald J Loney
(74) *Attorney, Agent, or Firm* — Oblon, McClelland, Maier & Neustadt, L.L.P.

(57) ABSTRACT

An insulating glazed element including at least one insulating glazing unit including at least a first glass sheet and a second glass sheet associated together by an intermediate frame that keeps them a certain distance from each other. The intermediate frame includes at least two horizontal spacers and at least two vertical spacers, which are transparent. The horizontal spacers include at least two compartments which are separate and contiguous.

17 Claims, 3 Drawing Sheets

(51) Int. Cl.

| | |
|---|---|
| ***E06B 3/67*** | (2006.01) |
| ***F25D 23/02*** | (2006.01) |
| *E06B 3/48* | (2006.01) |
| *E06B 5/00* | (2006.01) |

(52) U.S. Cl.
CPC ..... *E06B 3/66333* (2013.01); *E06B 3/66371* (2013.01); *F25D 23/028* (2013.01); *E06B 3/481* (2013.01); *E06B 5/00* (2013.01); *E06B 5/006* (2013.01); *E06B 2003/66385* (2013.01)

(56) References Cited

FOREIGN PATENT DOCUMENTS

| | | | |
|---|---|---|---|
| EP | 1 528 213 | A1 | 5/2005 |
| GB | 2 162 228 | A | 1/1986 |
| WO | 2014/009244 | A1 | 1/2014 |

OTHER PUBLICATIONS

Third Party remarks issued in Application No. EP15705978.3 dated Jan. 25, 2018 referencing DE 102011 009 879 A1.
Jan. 29, 2019 Response to the European Office Action dated Aug. 2, 2018 (with partial Machine Translation of discussion related to DE 102011 009 879 A1).
European Third Party Observation dated Feb. 2, 2018 in European Patent Application No. 15705978.3, 3 pages.

INSULATING GLAZED ELEMENT

1. FIELD OF THE INVENTION

The field of the invention is that of insulating glazed elements, in particular that of insulating glazed elements for a refrigerated chamber cabinet. These glazed elements may be used in any type of application such as glazings for refrigerator doors, freezer doors, or else general purpose glazings. Nevertheless, any other application requiring such insulating glazed elements may result in the implementation of the invention. An example of such an application is that of building windows with efficient thermal insulation.

2. SOLUTIONS OF THE PRIOR ART

The refrigerated chamber cabinet, also referred to as a refrigerated cabinet, used in most commercial premises for offering for sale and/or consumption products that must be kept at temperatures below 10° C., such as foodstuffs, is often equipped with glazed elements that convert it into a refrigerated display cabinet. These cabinets allow the products to be viewed by the consumer/customer and in particular allow a self-service use while keeping the products at a given temperature. The refrigerated cabinet thus represents the last link in the food cold chain before the product comes into the possession of the consumer. The development of products and in particular of foodstuffs is of prime importance but this must not take place at the expense of the quality of their storage. In other words, the refrigerated cabinet is used to show and/or display the products in a net volume at a given storage temperature (in general below 10° C.).

Thus, the display of products and more particularly of foodstuffs has an essential role in the sale of the products. A good display has in particular a good visual access to the products contained in the refrigerated chamber cabinet, without having to open it. However, while displaying the products, the refrigerated chamber cabinet must maintain a certain temperature and ensure the preservation of the products that must be chilled or frozen. Thus, owing to the laws of thermodynamics and conversely to the display function, the cabinets must at the very least protect the products against thermal stresses of all sorts, such as the closing and opening of the doors. Technically speaking, the roles of displaying and preserving the products at a given temperature in refrigerated chamber cabinets are in complete contradiction since the consumer must be able to have available products contained in the refrigerated chamber cabinet while benefiting from a refrigerated chamber cabinet having a wide opening and that is well lit, and the storekeeper must ensure a storage quality of the products with, as a priority, the closure or the reduction of the openings of the cabinets as much as possible, the least lighting possible and more particularly the fewest heat exchanges with the store surroundings.

Thus, several solutions have been envisaged in order to improve the thermal insulation performance of these glazed elements used for the refrigerated chamber cabinets, such as the use of vacuum glazing, the use of layers that reflect the infrared radiation or else triple glazings, of which one of the gas-filled spaces may be filled with krypton. However, the energy efficiency of such equipment remains to be improved and the use of such multiple glazings, due to their weight, generally requires the use of strong and full frameworks. Although these glazed elements and in particular their framework indeed carry out their mechanical role, they fall down on a considerable, both spatial and visual, bulkiness. These massive frameworks are a weak point from a point of view of the thermal insulation of the glazed element.

Thus, document GB 2 162 228 discloses a double glazing for a display case consisting of two glass sheets held in a parallel position and separated by spacers positioned between these sheets. The spacers contain a drying material and are completely or partly formed of transparent resinous material in order to allow good visibility of the merchandise kept in the display case and in order to prevent the formation of condensation on the inner surfaces of the glass sheets. Document GB 2 162 228 does not deal with the problem of reducing the visual and spatial bulkiness of the framework associated with the double glazing.

3. OBJECTIVES OF THE INVENTION

An objective of the invention is in particular to overcome these disadvantages of the prior art.

More specifically, one objective of the invention, in at least one of its embodiments, is to provide an opening insulating glazed element for a refrigerated chamber cabinet which can be fastened solidly and easily to the framework of a refrigerated cabinet.

More specifically, one objective of the invention, in at least one of its embodiments, is to provide an opening glazed element for a refrigerated chamber cabinet which is inexpensive while retaining good thermal insulation properties for longer than the glazed elements used conventionally.

Another objective of the invention, in at least one of its embodiments, is to use such an opening glazed element that offers a wide opening for a refrigerated chamber cabinet while avoiding as much as possible heat exchanges with the external surroundings.

Another objective of the invention, in at least one of its embodiments, is to provide an opening glazed element for a refrigerated chamber cabinet which makes it possible to ensure effective preservation of the products contained in the refrigerated cabinet while reducing the energy consumption for maintaining the required temperature inside the refrigerated chamber cabinet.

The invention, in at least one of its embodiments, also has the objective of providing such a glazed element that makes it possible to optimize the energy efficiency of the refrigerated cabinets while retaining the role of displaying the products contained in the refrigerated chamber cabinet.

Another objective of the invention is to produce a refrigerated chamber cabinet that meets the tightness criteria for these types of cabinets and that offers a production that is easy to implement and economically advantageous.

Another objective of the invention is to be able to be implemented on refrigerated cabinets already in service in order to enable them to meet the current energy efficiency criteria of cabinets of this type via an easy and economically advantageous implementation of the invention.

4. SUMMARY OF THE INVENTION

The invention relates to an insulating glazed element comprising:

a. at least one insulating glazing comprising at least one first glass sheet and one second glass sheet which are joined together by means of a spacer frame which holds them at a certain distance from one another, said frame extending along the horizontal edges and vertical edges of said at least two glass sheets and, between said at least two glass sheets, at least one internal space comprising an insulating gas and that is closed by at least one first peripheral seal and one second peripheral seal on the horizontal edges and at least one peripheral seal 27 on the vertical edges, said peripheral seals being positioned around said internal space, b. at least one framework that supports said at least one insulating glazing, said framework comprising:
   i. a fixed support and
   ii. a mobile support articulated to the fixed support that enables the opening and/or closing of the glazed element, the mobile support lacking lateral sashes.

According to the invention, the spacer frame comprises at least two vertical spacers made of transparent resin and at least two horizontal spacers, said spacers being connected together in order to form said frame, the horizontal spacers being composed of a profile comprising at least one first compartment and one second compartment, which are separate and contiguous, the second compartment having its thickness (B) less than or equal to the thickness (A) of the first compartment, the at least one peripheral seal on the vertical edges 102 is transparent, and the second compartment is at least partly immersed in the second peripheral seal.

A spacer frame denotes a rigid element positioned between the glass sheets close to the periphery thereof. The spacer frame according to the glazed element in accordance with the invention has the shape of a quadrilateral which matches the shape of the glazed element. Preferably, the quadrilateral is a parallelogram. More preferably still, the quadrilateral is a rectangle or square.

The adjectives vertical and horizontal are understood to denote locations close to opposite edges, that is to say non-contiguous edges of the frame and/or of the glazing, and which are facing each other.

The general principle of the invention is based on the use of a spacer frame in an insulating element that, besides its property of holding the two glass sheets at a certain distance from one another, has other features such as transparency over the vertical edges and structural properties over the horizontal edges that enable the fastening of the glazing via a direct connection between the spacer frame and the mobile support of the framework. The spacer frame according to the invention is formed owing to at least one fastening means connecting the vertical spacers and the horizontal spacers together. Generally, a fastening means should be understood to mean a connection between at least 2 elements to be assembled by means of a pressure, a glue, a pin, a screw of steel, galvanized steel, stainless steel or bronze screw type, or any other means that ensures the connection between said elements to be assembled. The peripheral seals on the vertical edges are transparent. According to the invention, the mobile support supporting the glazing lacks lateral sashes while offering an efficient solution both from the point of view of the thermal insulation and of its mechanical strength.

Such a glazed element has the advantage of offering a larger transparent surface area due to the absence of lateral sashes on the mobile support, the presence of a spacer frame and of transparent peripheral seals on the vertical sides while allowing an easy and economic fastening and also a very good thermal insulation.

The use of multiple glazings for refrigerated cabinets in order to increase the insulation is already known. The thermal insulation is usually determined by the overall performance qualities of a glazed element as multiple glazing, which are defined by Ug, the heat transfer coefficient of the glazing (calculated according to the EN673 and ISO10292 standards) and Uw, the heat transfer coefficient of the window. It is observed that several factors influence this coefficient, for example, the thermal bridges linked to the glass as is, the points of attachment of the glazing to the load-bearing structure, the seals distributed over the entire surface of the glazed element and finally the peripheral connecting seals between each glazing commonly referred to as spacers. In the prior art, the thermal improvement in general remains insufficient and the use of such multiple glazings, due to their weight, requires the use of a complete framework, extending over the entire periphery of the glazing, which gives them a good mechanical strength but constitutes a weak point in obtaining a good thermal insulation. Furthermore, the presence of a complete framework creates a considerable, both spatial and visual, bulkiness.

Furthermore, new energy-saving regulations and policies require the manufacture of glazed elements for refrigerated chamber cabinets, the thermal insulation performance of which is continuously improved.

The expression "mobile or opening support" is understood to mean the mobile part of the framework that supports the glazing and that makes it possible to open and close the glazed element.

Thus, the invention proposes to replace the conventional insulating glazed elements within a complete framework with a glazed element comprising at least one insulating glazing consisting of at least two glass sheets supported by a mobile support that lacks lateral sashes on the lateral edges, thus having a reduced thickness while giving it a better thermal insulation and a larger transparent surface area.

According to the invention, the glazed element may comprise at least two juxtaposed insulating glazings. Thus, when the glazed element is used to close a larger surface area, such as a large-capacity refrigerated cabinet or else a retail display space offering at least two opening leaves, the two multiple glazings being adjoining, the consumer is not visually impeded by the presence of lateral sashes. The consumer then has the impression that the refrigerated cabinet is provided with only a single transparent surface area.

According to one advantageous embodiment of the invention, the opening mobile support comprises horizontal profiles extending over the upper and/or lower edges of the glazing, which create, with the profiles of the fixed support, watertight and airtight barriers.

According to the invention, the spacer frame that holds the at least two glass sheets at a certain distance from one another is composed of at least two horizontal spacers and at least two vertical spacers. According to the invention, the horizontal spacers are composed of at least one first compartment and one second compartment that are separate and contiguous. According to one preferred embodiment of the invention, the second compartment is not in contact with the glass sheets and is immersed in the second peripheral seal, the peripheral seal thus having a structural role in addition to its customary functions of watertightness, airtightness, etc. The horizontal spacer according to the invention makes it possible, owing to at least one fastening means passing through the peripheral seal, to firmly attach the glazing to the mobile support of the framework. According to the invention, the vertical spacer is formed from a transparent resin. The horizontal and vertical spacers are firmly attached to one another by at least one fastening means in order to form the spacer frame. The spacer frame thus formed has numerous advantages since it makes it possible to increase the transparent surface area of the glazed element owing to the use of transparent vertical spacers and also to increase the structural rigidity of the glazed element owing to the use of horizontal spacers comprising at least two compartments. Furthermore, the spacer frame in accordance with the invention enables easy and strong fastening of the glazing to the mobile portion of the framework. This is particularly advantageous since the invention makes it possible to do away with the vertical jamb of the framework that is conventionally used.

Finally, the spacer frame according to the invention, once formed, may be stored until it is incorporated into a multiple glazing thus improving the productivity while facilitating the manufacture of the insulating glazing.

According to one advantageous implementation of the invention, the second compartment of the horizontal spacer is juxtaposed with the external portion of the first compartment, the first compartment having its internal portion directed toward the inside of the glazing and in direct contact with the internal space and its external portion directed toward the outside of the glazing. The second compartment located toward the outside of the glazing is then intended to receive at least one fastening means that makes it possible to connect the insulating glazing to the mobile support of the framework without disrupting the thermal insulation of the insulating glazing. Preferably, the first and second compartments of the horizontal spacer are hollow and a desiccative material is introduced into the first compartment located toward the inside of the glazing. In another preferred variant, the first compartment and second compartment of the horizontal spacer are solid and a desiccative material is incorporated into the first compartment located toward the inside of the glazing.

According to one particular embodiment of the invention, the second compartment of the horizontal spacer is sandwiched between the first compartment and the inner face of the glass sheet that is not in contact with the first compartment. An example of such a particular embodiment is to use a hollow first compartment and a solid second compartment. According to the invention, the solid compartment is intended to receive at least one fastening means that makes it possible to fasten the insulating glazing to the mobile support of the glazing.

The faces of double glazings or of multiple glazings are conventionally numbered from 1 to 4 from the outside to the inside, the inner faces 2 and 3 being the faces that face and delimit the internal space.

Thus, according to the invention, the spacer frame makes it possible to connect the at least one first and second glass sheets together and to fasten the insulating glazing to the mobile support of the framework.

According to one advantageous embodiment of the invention, the horizontal spacer is formed from a single profile comprising at least one first compartment and one second compartment. This configuration makes it possible to reduce the manufacturing time of the insulating glazing used according to the invention and also to reduce the manufacturing costs. This particular configuration also makes it possible to prevent a space from being created between the two compartments.

According to one particular embodiment of the invention, the horizontal spacer is formed by the combination of at least two profiles of different nature and/or shape. Another variant consists also in combining a profile that covers the entire length of the horizontal spacer with pieces of profiles positioned discontinuously that form blocks. The means for fastening the insulating glazing to the mobile support of the framework is then connected to the blocks.

According to the invention, the mobile support of the framework lacks lateral sashes on the lateral edges. According to one advantageous embodiment of the invention, the mobile support may take the form of a profile with a U- or L-shaped cross section that will be fastened directly to the insulating glazing at its lower and upper edges by means of a fastening means introduced into the second compartment of the horizontal spacer of the spacer frame. Thus, the transparent surface area of the glazed element according to the invention is increased. This has a more pronounced advantage if the glazed elements according to the invention are used for a refrigerated cabinet retail display space. The expression "retail display space" is understood to mean a set of refrigerated cabinets that may be aligned, placed in an L shape, in a Z shape, etc.

According to the invention, the at least two vertical spacers of the spacer frame are formed from a transparent resin. The expression "transparent resin" is understood to mean a chemical substance used for the manufacture of a plastic or else the plastic itself, which lets light through and makes it possible to see through.

According to one advantageous implementation of the invention, the transparent spacer is formed from a transparent resin, selected from polymethyl methacrylate (PMMA), polycarbonate, polystyrene (PS), polyvinyl chloride (PVC), acrylonitrile-butadiene-styrene (ABS), nylon or a mixture of these compounds.

The spacer frame used in the invention has the advantage of opposing possible exchanges of gas, moisture and dust between the external surroundings and the gas-filled space of the glazing while being transparent over at least the lateral portions, thus making it possible to see through to the products contained in the refrigerated chamber cabinet without the view of the consumer being obstructed by the presence of a spacer frame comprising non-transparent lateral spacers or more particularly the presence of lateral sashes. In the prior art, the spacers used in the insulating multiple glazings are generally an extruded or shaped hollow section made of metal or made of organic material, or else a profile with corner plates or a profile bent at the corners. In the latter case, the spacer is formed of a continuous profile bent at the corners.

According to one advantageous implementation of the invention, the first transparent peripheral seal used between the vertical spacers of the spacer frame and each of the glass sheets constituting the glazing is transparent. The first peripheral seal, commonly known under the name tightness barrier, is formed from a transparent resin selected from an acrylic or a rubber- or silicone-modified acrylic double-sided tape, more commonly known by the name "double-sided adhesive tape of pressure-sensitive adhesive (PSA) or transfer tape type", or a transparent (butyl rubber) hot-melt adhesive or a structural adhesive of acrylic or epoxy type, optionally crosslinkable under the action of UV rays.

These materials, in addition to being transparent, have a good performance in terms of tightness with respect to water vapor and gases and furthermore have a good adhesion to the glass while withstanding ozone, oxygen and ultraviolet rays.

Conventionally, the peripheral tightness seal is a bead of mastic generally based on polyisobutylene, more commonly referred to as butyl rubber, which is particularly effective in terms of tightness with respect to water vapor and gases, but the mechanical performance of which is insufficient for holding the glass sheets together.

According to one advantageous implementation of the invention, along the horizontal edges of the insulating glazing, the second peripheral sealing seal is a mastic having a structural function, such as silicone, polyurethane (PU) or modified silicone (MS-Polymer). These mastics have a very good mechanical strength, in addition to their properties of watertightness and airtightness and of adhesion to the glass.

The combination of the spacer frame with a two-compartment horizontal spacer firmly connected to the mobile support of the framework, with this second seal with a structural function embedding one of the compartments and the fastening means passing through it, generates a mechanical rigidity that is advantageous for the mechanical strength of the glazed element.

According to one particular implementation of the invention, a second peripheral seal along the vertical edges of the glazing may be used. Preferably, the second peripheral seal is produced from a resin selected from a glue comprising silicone, hybrid mastic comprising silicone and polyurethane, hot-melt or a mixture of these various compounds.

These compounds have a good adhesion to the glass sheets and mechanical properties that enable them to ensure that the glass sheets are held against the spacer. Furthermore, these compounds are elastomers that have elastic properties after crosslinking. They have a good oxidation resistance and have a low permeability to water vapor. Silicones, which are one- or two-component elastomers, are particularly preferred due to their adhesion to glass, their resistance to external agents and their aging. Butyl rubbers of "hot-melt" type are hot-melt rubbers that have a good resistance to moisture penetration. Their firm consistency at the standard temperatures makes them good candidates as sealing seals.

According to one advantageous implementation of the invention, the horizontal edges of the glazing comprising the spacer frame and also the peripheral seals are masked by screenprinting applied to one of the faces of at least one glass sheet. Preferably, the screenprinting is applied to the glass sheet that will be directed toward the outside of the refrigerated chamber (face 4). The mobile support, present only on the horizontal edges of the glazing, may also play a part of this role, namely masking the edge of the glazing which is not transparent.

According to one advantageous implementation of the invention, the at least one insulating glazing of the glazed element has a heat transfer coefficient Ug ranging from 0.3 to 1.8, preferably from 0.6 to 1.8 and most preferably from 1.0 to 1.8 $W/m^2$. The heat transfer coefficient Ug corresponds to the amount of heat that the material lets through. This type of glass enables a high insulation performance and therefore enables savings in terms of energy and meets the new energy-saving regulations.

According to one particular embodiment of the invention, the at least one insulating glazing comprises at least one first glass sheet and one second glass sheet which are joined together by means of a spacer frame, said sheets being of different sizes and may therefore be offset over the entire periphery of the glazing. This is then referred to as asymmetric glazing. This difference in size between the at least first glass sheet and second glass sheet has the advantage of being able to easily implement, on this portion, the mechanical assembling of the mobile support on the horizontal or lower and upper edges of a multiple glazing or else of placing therein a heating network which could be deposited on the offset portion of the glass in order to avoid the appearance of condensation at the edge of the glazing.

According to one particular embodiment of the invention, the at least one insulating glazing comprises at least one safety glass sheet.

The expression "safety glass sheet" is understood to mean thermally tempered glasses or else laminated glasses.

This type of glass enables people to be protected against the risk of injury in the case of broken glass.

The invention also relates to the use of an insulating glazed element according to the invention as a door of a refrigerated chamber cabinet.

The invention also relates to a refrigerated chamber cabinet comprising at least one glazed element as described above.

According to one particular implementation of the invention, the refrigerated chamber cabinet comprises at least one glazed element that comprises at least two insulating glazings.

According to one particular implementation of the invention, the refrigerated chamber cabinet comprises at least one glazed element that comprises at least two insulating glazings and of which the tightness between the at least two insulating glazings is achieved by means of a transparent tightness element positioned on at least the lateral edge adjoining the lateral edge of the neighboring glazing.

The advantages of these refrigerated chamber cabinets are the same as those of the glazed elements, they are not explained more fully.

The invention also relates to a partly transparent spacer frame positioned in an insulating multiple glazing that enables solid and easy fastening of the glazing to the framework of the glazed element.

5. LIST OF THE FIGURES

Other features and advantages of the invention will become more clearly apparent on reading the following description of one preferred embodiment, given by way of simple illustrative and nonlimiting example, and from the appended drawings, in which.

Figure 3A:
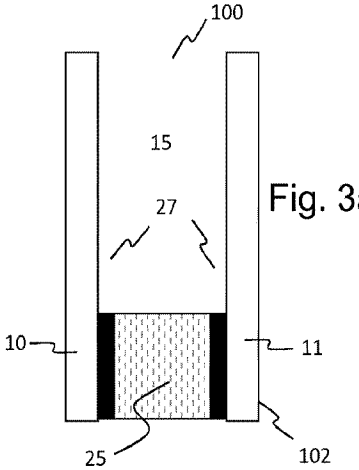
Figure 3B:
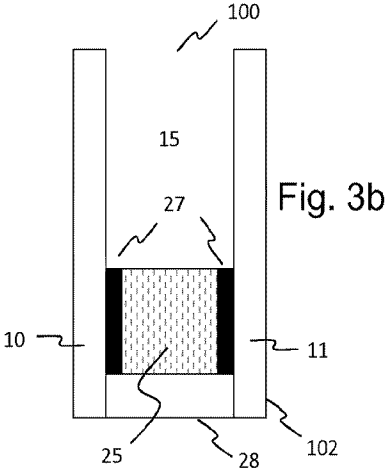
Figure 6:
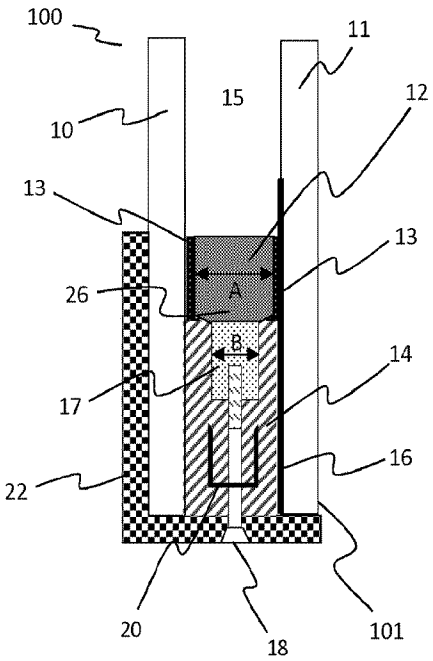
Figure 5:
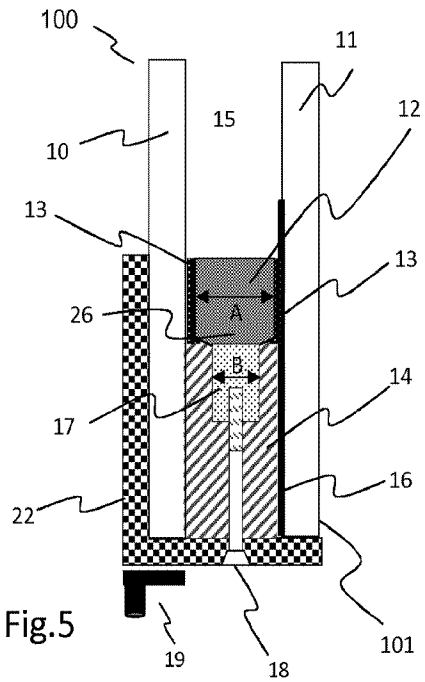
Figure 4:
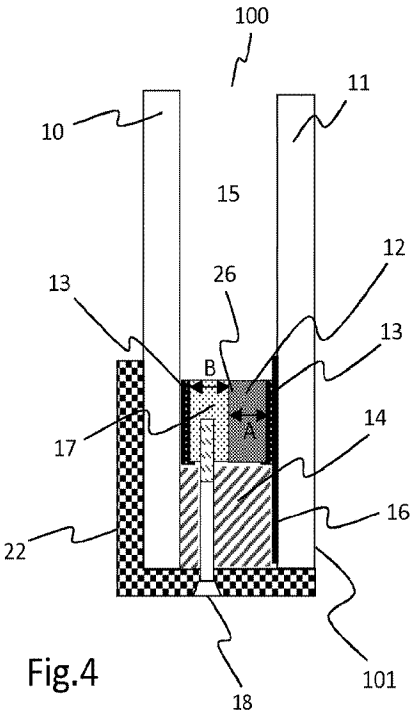
Figure 9:
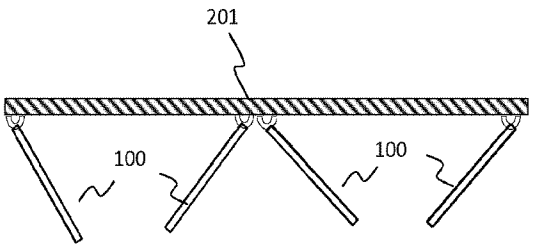
Figure 10:
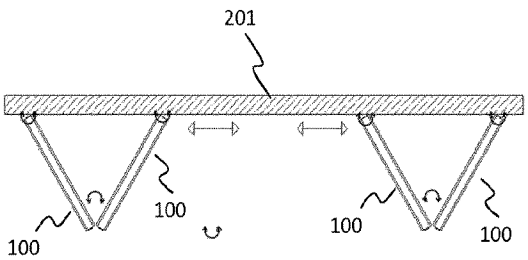
Figure 7:
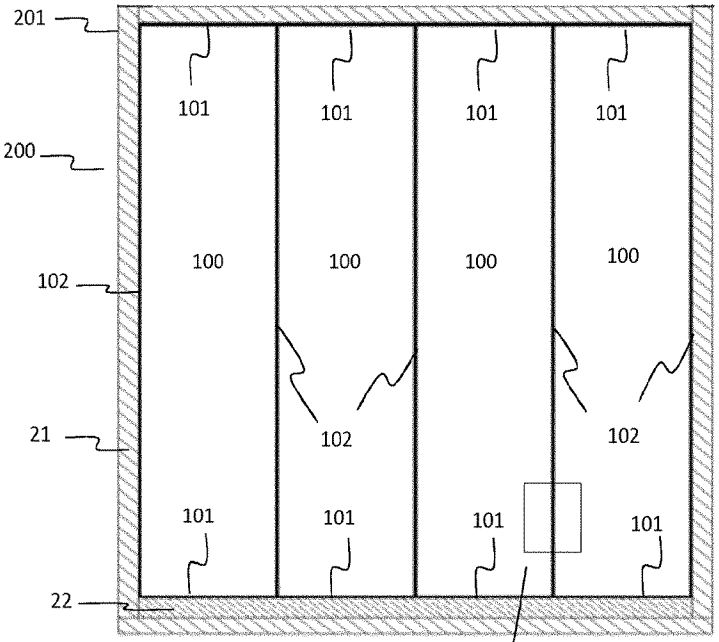
Figure 8:
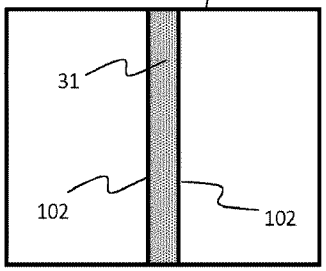

FIGS. 3*a* and 3*b* illustrate a cross section of a vertical edge of an insulating glazing according to the invention in the vicinity;

FIGS. 4 to 6 illustrate a cross section of a horizontal edge of an insulating glazing according to the invention according to various variants;

FIG. 7 illustrates a glazed element according to one embodiment of the invention;

FIG. 8 illustrates a closer view of the glazed element illustrated in FIG. 7;

FIG. 9 illustrates a method of opening of the glazed elements;

FIG. 10 illustrates a method of concertina-style opening of the glazed elements.

6. DESCRIPTION OF ONE EMBODIMENT OF THE INVENTION

When products must be stored at a given temperature in a refrigerated cabinet, these products must remain visible to the consumer. For this reason, the refrigerated chamber cabinets, also referred to as refrigerated cabinets, used in most commercial premises for offering for sale and/or consumption products that must be kept at given temperatures, are often equipped with glazed elements that convert them into refrigerated display cabinets. Thus, these cabinets allow the products to be viewed by the consumer/customer and allow a self-service use, while guaranteeing that the temperature in the chamber of the cabinet is maintained.

Thus, the display of foodstuffs has an essential role in the sale of the products. A good display has in particular a good visibility of the products contained in the refrigerated cabinet. However, while displaying the products, the refrigerated cabinet must maintain a certain temperature and ensure the preservation of the products that must be chilled or frozen.

Refrigerated cabinets are generally in four parts, namely the structure bearing the cabinet, refrigerating elements, the effective sales space, in other words the container, and preferably glazed doors to enable the stocking of the refrigerated cabinet and access by the consumer to the products offered for sale.

The structure bearing the cabinet is mainly composed of an insulated shell in the form of "steel-insulating foam-steel" type sandwich panels. The quality of the implementation and the thickness of the insulating material will determine the energy performance of the cabinet with respect to penetrations (or negative loss). Today, refrigerated cabinets tend to be increasingly attractive by having in particular a load-bearing structure made of glass. The question of the energy performance then arises. Thus, according to one particular embodiment of the invention, the glazed elements such as for example shown by FIG. 7 may be used to form the doors of the refrigerated chamber cabinet or to form the refrigerated chamber cabinet per se.

The refrigerating elements are generally inside the cabinet.

The invention will be described more particularly for refrigerated chamber cabinets or else refrigerated display cabinets, of upright cabinet shape, but the invention is not limited to this type of cabinets. Indeed, there are several variants of these refrigerated display cabinets. Some are in the form of upright cabinets and then it is the door itself which is a transparent glazed element, others constitute chests and it is the horizontal cover which is glazed in order to allow the contents to be seen, and yet others constitute display case counters and it is the portion that separates the public from the merchandise that is glazed. Irrespective of the variant of these refrigerated display cabinets, it is also possible to produce glazed walls so that the entire contents are visible from the outside.

In display cases of this type, it is necessary for the merchandise to remain completely visible to the clientele so that it is possible to preselect the merchandise without opening the cabinet and to needlessly avoid any loss of energy, therefore resulting in excess energy consumption. Excess energy consumption is often also linked to the use of glazed elements which are not sufficiently insulating. Thus, the glazed portion, more particularly the opening glazed portion of the refrigerated cabinet also referred to as an opening leaf or door of the refrigerated display cabinet should preferably not be delimited by a frame, or at the very least over its lateral edges, in order to give the customer the impression that the cabinet is provided with an opening leaf made from a single part, with no separation, while performing its thermal insulation role. It is also necessary to avoid the glazed portions of the cabinets and particularly of the doors being covered with condensation and it is necessary for these glazed portions to withstand the pressures due to the frequent openings/closings of these opening leaves by the clientele or else the employees responsible for stocking the refrigerated cabinets.

Conventionally, the refrigerated cabinet doors comprise a double or triple glazing which requires the use of a framework that extends over the entire periphery of the glazing in order to give it good mechanical strength. Unfortunately, this complete framework, in addition to creating considerable spatial and visual bulkiness, does not always have good thermal insulation and is not attractive.

Thus, in connection with FIGS. 1 to 6, an insulating glazing 100 is presented that will be used to manufacture the glazed element 200 according to the invention.

The insulating glazing 100 is a double glazing comprising a first glass sheet 10 and a second glass sheet 11 of soda-lime-silica type. These glass sheets have a thickness ranging from 0.5 mm to 15 mm (for example 4 mm thick soda-lime-silica glass sheets) joined together by means of a spacer frame 50 which holds them at a certain distance from one another.

In the case of safety glazing, the glass sheets 10 and 11 may be replaced by laminated glasses comprising at least one stack of a polyvinyl butyral (PVB) plastic sheet sandwiched between two glass sheets. Such stacks have total glass thicknesses (not including the thickness of the PVB sheet(s)) ranging from 4 mm up to and including 24 mm.

Between the two glass sheets 10, 11, an internal space 15 comprising an insulating gas is closed by the spacers and a first peripheral seal 13 along the horizontal edges 101 and a first peripheral seal 27 along the vertical edges 102. A second peripheral seal 14 is placed along the horizontal edges 101. In one particular embodiment of the invention, a second peripheral seal 28 may be placed along the vertical edges 102, as illustrated in FIG. 3*b*.

According to the invention, the glass sheets 10, 11 may be of different sizes.

According to the invention, the spacer frame 50 is composed of at least two vertical spacers 25 and at least two horizontal spacers 26. The horizontal spacers are connected to the vertical spacers by at least one fastening means 24 that connects the vertical spacer 25 to the compartment 17 of the horizontal spacer 26.

Figure 1:
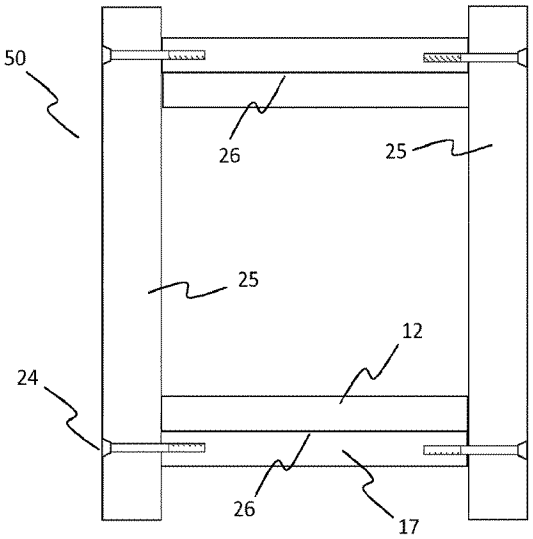
FIG. 1 illustrates the spacer frame formed by the horizontal and vertical spacers.
Figure 2:
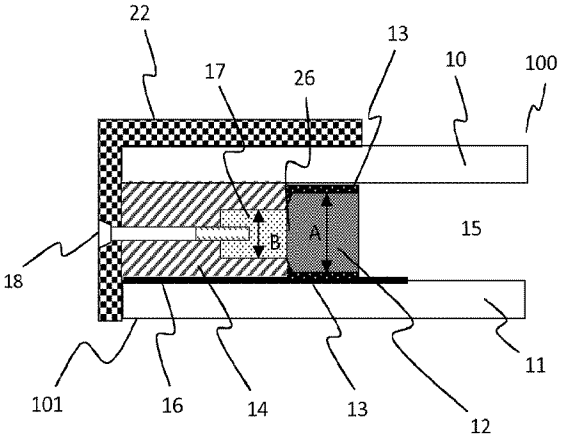
FIG. 2 illustrates a cross section of a horizontal edge of an insulating glazing according to the invention.

According to the invention, the horizontal spacer 26 is composed of at least one first compartment 12 and one second compartment 17, which are separate and contiguous. Preferably, the second compartment of the horizontal spacer is juxtaposed with the external portion of the first compartment 12, the first compartment having its internal portion directed toward the inside of the glazing and in direct contact with the internal space and its external portion directed toward the outside of the glazing as shown in FIG. 2.

According to one variant of the invention, the second compartment of the horizontal spacer may be sandwiched between the first compartment and the inner face of the glass sheet that is not in contact with the first compartment as shown in FIG. 4. According to one preferred embodiment of the invention, the compartments 12 and 17 preferably result from a single profile. It is understood that they may also result from the combination of several profiles of different shape and/or nature.

Preferably, the second compartment 17 is placed toward the outside of the glazing and is not in direct contact with the glass sheets 10 and 11. Its thickness (B) is therefore smaller than the thickness (A) of the first compartment 12. A minimum distance of 1 mm between the compartment and the glass sheets is preferable. According to one preferred embodiment of the invention, the second compartment 17 is at least in contact with the second peripheral seal 14 and is preferably immersed in the second peripheral seal 14 and it enables at least one fastening means 18 passing through the second peripheral seal 14 to firmly attach the glazing to the mobile support of the framework 22. Preferably, the second compartment 17 is hollow. The first compartment 12 used according to the invention may be hollow or solid. It may be of hexagonal shape. When the first compartment 12 is hollow, then the load with the chambers of the multiple glazing must be balanced. The first compartment 12 may in particular comprise a hollow cross section which has, for example, the shape of a square. This section is partially open towards the internal space 15 comprising the insulating gas. A desiccative material may then be positioned inside the first compartment 12.

According to the invention, the first and second compartments 12 and 17 may be profiles made of galvanized steel, aluminum, stainless steel or composites, etc.

According to the invention, the vertical spacer 25 extending along the lateral edges of said at least two glass sheets is formed from a transparent resin. Thus, the customer or employee facing the refrigerated chamber cabinet comprising at least two opening leaves has the impression that the refrigerated chamber cabinet is provided with only a single glazed face and their view is not impeded by the presence of a frame or lateral sashes, whereas the glazed element is composed of several glazings.

According to one preferred embodiment of the invention, the vertical spacer 25 placed on the lateral edges of the multiple glazing is formed from a transparent resin and, preferably, manufactured from a material selected from polymethyl methacrylate, polycarbonate, polystyrene, polyvinyl chloride PVC, acrylonitrile-butadiene-styrene (ABS), nylon or a mixture of these compounds.

According to one general embodiment of the invention, the peripheral seal (27) extending along the lateral edges between the at least two glass sheets and the vertical spacer 25 is formed from a transparent resin. Thus, the customer or employee facing the refrigerated chamber cabinet comprising several glazings has the impression that the refrigerated chamber cabinet is provided with only a single glazed face.

Such a seal 27 is preferably manufactured from a tightness material selected from an acrylic or a rubber- or silicone-modified acrylic double-sided tape, also known as double-sided adhesive tape "of pressure-sensitive adhesive (PSA) or transfer tape type", or a transparent (butyl rubber) hot-melt adhesive or a structural adhesive of acrylic or epoxy type, optionally crosslinkable under the action of UV rays.

One preferred variant consists in inserting a primer layer between the peripheral seal 27 and the glass sheet 10 or 11. The latter may have been precoated with a low-emissivity (low-E) layer.

Another preferred variant consists in inserting a primer layer between the peripheral seal 27 and the vertical spacer 25.

One variant that is most preferred consists in inserting a primer layer between the peripheral seal 27 and the glass sheet 10 or 11 and another primer layer between the peripheral seal 27 and the vertical spacer 25.

The term "primer layer" is understood to denote a layer of an organic product which adheres well to the peripheral seal and which has selective adhesive properties with respect to the glass or the transparent resin of which the spacer is made. Examples of such primers are the compounds of the silane family and of the acrylic family. Good adhesion is understood to mean adhesion that requires a positive tear-off force and is characterized by cohesive failure in the test described in example 2 below.

According to one particular embodiment of the invention, a second peripheral seal 28 may be positioned on the external portion of the vertical spacer 25 as shown in FIG. 3*b* and fills the space between the inner faces of the glass sheets. It is then preferably manufactured from a transparent resin. Such a seal is preferably manufactured from a sealing material which is a glue comprising silicone, hybrid mastic comprising silicone and polyurethane, hot-melt or a mixture of these various compounds.

According to one preferred embodiment of the invention, a desiccative material may be positioned inside the multiple glazing. It may be positioned inside the first compartment 12 or at various locations of the glazing such as for example in the mobile support of the framework. Preferably, the desiccative material is incorporated into the first compartment 12. Thus, the dehydration of the air or of the gas trapped between the glass sheets may be obtained by a desiccative (or dehydrating) material contained in the first compartment 12. This first compartment 12 is then provided with orifices (slits or holes) in order for the desiccative material to be in communication with the internal air or gas. This desiccative material is generally a molecular sieve, sometimes silica gel. The absorption capacity of these desiccative materials is greater than 20% of their weight. After dehydration, in a new insulating glazing, the moisture content is low enough for there to be no condensation between the glasses for temperatures below −60° C.

According to one preferred embodiment of the invention, the first peripheral seal 13 and second peripheral seal 14 may comprise polyisobutylene tightness layers positioned respectively between the compartment 12 and each of the first and second glass sheets 10, 11. The second peripheral seal 14 may also comprise a bead of polysulfide or of silicone resin positioned in contact with the tightness layers 13 between each of the glass sheets 10, 11 and the first compartment 12.

According to one preferred embodiment of the invention, the second peripheral seal is a mastic with a structural function, selected from silicone, polyurethane (PU) or modified silicone (MS-Polymer).

According to one preferred embodiment of the invention as shown in FIG. 2, a screenprinting 16 may be affixed to the horizontal edges of the glass sheet 11 on its inner face in order to perfect the esthetic appearance of the glazed element by masking the horizontal spacer 26, the seals 13 and 14 and the fastening means 18.

According to one particular embodiment of the invention, on the horizontal edges between the two glass sheets, a structural reinforcing profile 20 may be inserted into the second peripheral seal 14 as shown for example in FIG. 6. Preferably, the reinforcing profile 20 is immersed in the second peripheral seal 14 so as to rigidify the glazing. The reinforcing profile 20 is in particular passed through by at least one fastening means 18 that makes it possible to fasten the glazing to the mobile framework. This profile contributes to the mechanical rigidity of the glazing. It may be made of steel, stainless steel or reinforcing plastic. Preferably, the reinforcing profile 20 has a U shape, but it is understood that it may be of different shape such as an L shape or any other shape that makes it possible to rigidify the whole of the glazed element.

According to one preferred embodiment of the invention, the internal space 15 comprises an insulating gas comprising at least 85% argon or any other inert gas capable of optimally insulating the glazing. Suitable gases should be colorless, nontoxic, noncorrosive, nonflammable, insensitive to exposure to ultraviolet radiation, denser than air and having a lower thermal conductivity. Argon (Ar), xenon (Xe) and krypton (Kr) are examples of such gases which are commonly substituted for air in insulating glazing panels. It is also understood that the internal space 15 may be filled with air.

The use of multiple glazings for refrigerated cabinets is already known. The use of such multiple glazings, due to their weight, requires the use of a complete framework over the entire periphery of the glazing which gives them a good mechanical strength, but which creates a considerable spatial and visual bulkiness and also a weak point from a point of view of the thermal insulation.

Thus, the inventors propose a multiple glazing which may be used in a glazed element suitable for acting as a door or as an opening for a refrigerated chamber cabinet without requiring the presence of a mobile support extending over the entire periphery of the glazing.

According to the invention, the glass sheets 10 and 11, respectively in the outer and inner position, may be glass sheets of simple soda-lime type, tempered glasses or else laminated glasses, flint glasses in order to improve the light transmission, glasses that are optionally bulk-tinted, for the esthetic appearance, or glasses on which a scratch-resistant or hydrophobic film may be deposited. Furthermore, functions are increasingly added to these glazings by depositing on their surface thin layers intended to give them a particular property depending on the targeted application. Thus, the glass sheets may be covered, on their outer and/or inner faces, with one or more layers selected from the following list: an anti-fog layer, an antibacterial layer, a hydrophobic layer in order to avoid the stagnation of the water of condensation or else an easy-to-clean layer, a semi-reflective or reflective layer, a low-emissivity layer or else a pyrolytic layer. Thus, layers having an optical function exist, such as the layers known as antireflection layers composed of a stack of layers alternately having high and low refractive indices. For an antistatic function, or a heating function of deicing type, it is also possible to provide electrically conductive thin layers, for example based on a metal or on a metal oxide that is doped. For a thermal, low emissivity or antisolar function for example, it is possible to turn to thin layers made of metal of silver type or based on metal oxide or nitride. In order to avoid condensation, the insulation performance of the glazing has been increased owing to, in particular, the use of double or even triple glazing in order to form the glazed portions of the refrigerated cabinet but also the presence of low-emissivity layers on at least one of the faces of the glass sheets included in the glazing, of thin layers that reflect infrared radiation or else the use of triple glazings, of which one of the gas-filled spaces may be filled with krypton. It is also possible to heat at least some faces of the glazing.

The insulating glazing 100 is thus used to manufacture a glazed element 200 as represented in FIGS. 7 to 10.

Generally, in the multiple glazings comprising two or even three or more glass sheets, the spacer frame is attached inside the insulating glazing via its lateral faces to the internal faces of the glass sheets by butyl rubber which has the role of making the inside of the glazing water vapor tight. The spacer frame is positioned set back inside the glazing and in the vicinity of the edges of said glass sheets, so as to make a peripheral groove into which the tightness means of mastic type, such as a polysulfide, silicone or polyurethane, are injected. The mastic reinforces the mechanical assembly of the two glass sheets and provides liquid water and solvent tightness. This spacer frame and also the tightness means are not attractive and are generally masked by an outer framework in which the glazing lies. However, this visible framework represents a visual barrier, an impediment to the access to the merchandise contained in the refrigerated cabinet. Besides its structural role, it must generally be a poor conductor.

Conventionally, the framework comprises various parts including:

- the fixed support, also referred to as a fixed frame, which is a base constituent element of the framework, represents the part of the framework fixed to the load-bearing structure of the refrigerated cabinet,
- the mobile support, also referred to as an opening frame, which is the mobile part of the framework. It generally comprises the airtightness seals. The fixed support then comprises profiles that create, with those of the opening leaf, barriers to water and air. Housings for the hardware are also provided therein.

Generally, the fixed and mobile supports are composed of horizontal and vertical edges. This configuration makes it possible to support the insulating glazing but also to contribute to the thermal insulation.

The frameworks are generally manufactured from various materials such as wood, PVC (polyvinyl chloride), aluminum or else composite materials. Thus, the framework may also be transparent in order to let more light through. In this variant, the framework may be made from any plastic such as PMMA or any transparent resinous material that provides a light transmission of greater than 10% through the whole of a profile of the framework.

The invention therefore proposes a glazed element 200 comprising at least one multiple glazing 100 supported by at least one framework, of which the mobile support 22 or opening frame, also referred to as the opening leaf, lacks lateral sashes.

The structure of the glazing used for the glazed portions and in particular the opening leaves of the refrigerated chamber cabinet according to the invention has the advantage of conferring a rigidity and a strength that are equivalent to those of a single glazing even though said glazing lacks mobile support over the whole of the periphery of the glazing, or more particularly vertical sashes, while guaranteeing good thermal insulation. Thus, the bulkiness is greatly decreased thus offering a greater visibility of the contents of the refrigerated cabinet. Moreover, in order to ensure an optimal thermal insulation, the glazing 100 has a heat transfer coefficient Ug ranging from 0.3 to 1.8, preferably from 0.6 to 1.8 and most preferably from 1.0 to 1.8 $W/m^2$.

"Heat transfer coefficient Ug" is understood to mean the amount of heat passing through the glazing, under steady state conditions, per unit of surface area, for a difference of one degree Celsius between the surroundings, for example exterior and interior. These Ug values are in particular achieved owing to a low-emissivity layer (low-E layer). For example, the glass sheets used may be glass sheets of Thermobel, TopN or TopN+T type from AGC. The glass sheet may thus be covered with thin layers made of metal of silver type or based on metal oxide or nitride. Thus, the glazing 100 used has a very efficient Ug coefficient while exhibiting esthetic qualities.

The invention relates more particularly to a refrigerated chamber cabinet in which fresh, refrigerated or frozen products are displayed, the usual name of which is a "refrigerated display cabinet". It is understood that the invention is not limited to this type of cabinet, any cabinet with a chamber having a hot, wet or dry atmosphere also comes under the scope of the invention.

Another subject of the invention is a refrigerated chamber cabinet that overcomes the various drawbacks of the prior art, and that meets the tightness criteria for cabinets of this type and that offers a cabinet that is easy to use and economically advantageous, whether this is for the manufacture of new cabinets or improving the performance of a cabinet already in service.

The refrigerated chamber cabinet according to the invention has the advantage of providing the customer with increased visibility of its contents since the opening leaves lack mobile support on the lateral edges of the glazing panel, while guaranteeing a good thermal insulation.

The glazed element for producing such a refrigerated cabinet is described above and is represented by way of example by FIGS. 7 to 10.

According to one particular embodiment of the invention, the tightness between the two opening leaves is achieved by means of a transparent tightness element 31 attached to the glazing. The tightness is for example provided on the lateral edges without a lateral sash by a transparent lip seal or flange seal or a seal of brush or felt type on the lower and upper edges of the glazing. Preferably, the insulating glazing is provided on at least one of its edges with a transparent tightness element such as an adhesively bonded profile, in particular made of plastic. The term "profile" is understood to mean prefabricated profiles of all types having a shape suitable for the function of said profile. Preferably, the profile is a plastic profile in order to be able to take up the deformation of the glazing without large stresses. Such a profile adhesively bonded to at least one of the edges of the glazing may fulfil various functions such as the protection of the edges of the glazing, the attachment of various elements such as hinges or handles or else the esthetic appearance of the opening leaf. Furthermore, the use of a profile is advantageous for the production of the magnetic contacts between the opening leaf and the cabinet and/or the neighboring opening leaf.

Thus, compared to conventional refrigerated chamber cabinets, the vertical elements for receiving the lateral edges of the at least two opening leaves are eliminated, the lateral edges being those which are not attached along the edges to the walls of the cabinet. The vertical elements were those on which the opening leaf came into abutment so that the tightness and the blocking of the opening leaves were ensured. The absence of the vertical elements makes it possible to simplify the structure of the cabinet while improving its esthetic appearance.

According to one advantageous embodiment of the invention, said tightness element placed on the lateral edges of the glazing is a transparent lip seal or flange seal which has the advantage of not creating stresses and resistance in the glazing and of not creating a risk of a break in the tightness over the entire length.

Preferably, the lower and upper corners of the glazing are equipped with an element capable of receiving a magnetic part in order to ensure contact with the cabinet and/or the edge of the neighboring opening leaf. Thus, good contact and good abutment is achieved between the jamb and the cabinet and the neighboring jamb while enabling a hermetic and esthetic closing of said opening leaf.

According to one advantageous variant of the invention, the tightness between the opening leaf and the upper and lower edges of the cabinet is achieved by means of compressible magnetic tightness seals positioned on said edges of the cabinet so that the contact is achieved at the periphery of the opening leaf.

In this way, the internal surface of the opening leaf is lightened and the compressible magnetic tightness seal allows hermetic contact that absorbs the slight deformation which may appear over this contact length. Indeed, since this contact length is shorter than that at the lateral ends of the cabinet, the deformation bowing is much smaller and the contact may be achieved over the periphery of the opening leaf without risk of a break in the tightness.

According to one advantageous variant of the invention, the articulation pin is off-center with respect to the plane of said opening leaf and the articulation element is fastened to the opening leaf, in particular to the mobile support found on the horizontal edges of the glazing.

According to one variant of the invention, the insulating glazing has glass sheets of different sizes over the entire periphery of the glazing. The asymmetry of the two glass sheets facilitates the mechanical assembling of the mobile support of the framework over the lower and upper edges of a multiple glazing and in particular of the double glazing within the opening leaf.

According to one particular embodiment of the invention, the opening leaf is provided with a return element of rod-spring type. Such an embodiment is particularly advantageous from an esthetic viewpoint. Indeed, it makes it possible to eliminate the use of the torsion bars customarily used, these bars generally being positioned in the framework due to their considerable volume.

These types of assemblies have numerous advantages. Firstly, due to the rigidity and mechanical strength of the insulating glazing, it is not necessary to join the insulating glazing to a framework over the entire periphery of the glazing as in standard multiple glazings, which framework substantially increases the general bulkiness of the opening leaves and therefore consequently that of the cabinet.

According to one preferred embodiment of the invention, a mobile support of the framework 22 is positioned on the lower and upper edges of the multiple glazing in order to be able to hold and fasten the opening leaf to the fixed frame part 21, that is to say the fixed support for the opening leaf of the refrigerated chamber cabinet. It is for example in the form of an L- or U-shaped profile that extends over a portion or all of the lower and/or upper edges of the at least one insulating glazing.

The mobile support 22 may be made of aluminum, PVC, steel, stainless steel or else any material suitable for fulfilling this function of holding and fastening the glazing to the fixed frame part. As specified for the framework, the mobile support 22 may also be transparent and made from the transparent materials described for the framework. The heat losses through the mobile support 22 must be minimal in order to limit or prevent the increase in the coefficient Uw. Owing to the mobile supports, the transfer of the mechanical load by the glass takes place between the lower and upper parts of the multiple glazing. Such a mobile support is represented in FIGS. 2, and 4 to 6.

The presence of mobile supports 22 on at least one portion of the horizontal edges of the multiple glazing allows the incorporation of at least one portion of the mechanism intended to enable the opening and closing of the opening leaves, and in particular the fastening of two, three or even four bearing or pivot points 19 as shown by FIG. 5, which are mainly anchoring points for the opening and closing movements of the opening leaves. The mechanism intended to enable the opening and closing of the opening leaves is, according to one particular embodiment of the invention, composed of several parts that make it possible to connect the opening leaf to the refrigerated chamber cabinet and more particularly to connect it to the fixed support 21.

It is understood that the fixed support may be the frame of the refrigerated chamber cabinet.

According to one advantageous implementation of the invention, a damping abutment system for closing the opening leaf and/or keeping it in the open position may be placed on or in at least one of the mobile supports 22.

According to another advantageous embodiment of the invention, a desiccative material may be incorporated into at least one of the mobile supports.

According to one advantageous implementation of the invention, at least one of the mobile supports may comprise a tightness barrier that comes into abutment with the door when it is in the closed position. The tightness barrier may in particular be a flange seal, lip seal, brush seal or felt seal.

According to one particular embodiment of the invention, the refrigerated cabinet is capable of receiving the fixed support of the glazed element according to the invention.

The expression "fixed support" is understood to mean the part of the framework 21 which is fastened to the refrigerated chamber cabinet and that will support the opening leaf when it is in both the open and closed positions. The fixed support or fixed frame may be made of aluminum, PVC, steel or else wood. The fixed frame will in particular comprise a portion of the mechanism intended to enable the opening and closing of the opening leaves, the other portion being fastened to the opening leaf and according to one particular embodiment of the invention, to the other portion of the mechanism for opening and closing the opening leaf placed on at least one of the two sills. Thus, the fixed frame may comprise 2, 3 or 4 bearing or pivot points, and the electrical or pneumatic movement control mechanism of jackscrew type with or without shafts.

The fixed support may in particular comprise a damping abutment for closing the opening leaf and keeping it in the open position. Preferably, a tightness barrier is placed around the perimeter of the fixed frame. Such a barrier may be of flange seal, lip seal, brush seal or felt seal type in abutment with the door in the closed position.

According to the invention, the opening leaves of the refrigerated cabinet may be opened in various ways. Thus, the opening leaves may be opened by simple pivoting from the inside to the outside. The opening leaves may also be opened by sliding the opening leaves from the right to the left or from the left to the right by horizontal translation with or without overlapping of one of the opening leaves over the other. The opening leaves may also be opened by concertina-style opening.

When the glazed element 200 is used as a door for a refrigerated cabinet, the doors opening from the inside to the outside, then the cabinet preferably lacks vertical internal intermediate jambs extending over the height of the cabinet on which the opening leaf would come into abutment in order to achieve the tightness.

The opening and the closing of the mobile portion of the glazed element 200 according to the invention is preferably automated, that is to say controlled by means of an electrical system.

According to one particular embodiment of the invention, the refrigerated chamber cabinet may be equipped with a system of internal lighting of the multiple glazing. The lighting may be produced in particular by means of LEDs positioned on at least one of the lower or upper edges of the glazing, a light may also be projected into the fields of vision of the glass panel(s) constituting the multiple glazing.

Video or stationary billboards may be incorporated inside the multiple glazing and in particular inside double or triple glazing. Electrically or mechanically controlled blinds may be added to the refrigerated chamber cabinet.

This type of refrigerated chamber cabinet thus described is easy to produce and to install since it does not require very many parts. It provides incontestable thermal insulation and also very good tightness while having an esthetic appearance.

By way of example, FIGS. 7 to 10 represent a glazed element 200 according to the invention. More particularly, FIG. 7 shows a glazed element comprising 4 insulating double glazings 100, respectively 1 to 4 going from the left to the right.

The opening leaves may be opened for example as illustrated in FIGS. 9 and 10. In FIG. 9, each glazed element is articulated separately and over one of its edges via pivot elements 19 connecting the fixed support 21 and the mobile support 22 of the framework. The opening leaves then open from the inside toward the outside. In FIG. 10, the glazed elements are coupled in pairs in order to be opened by concertina-style opening. In this scenario, each glazed element 200 has hinge elements on two sides. On one side, the pivot element 19 connects the fixed support 21 and the mobile support 22 of the framework. On the other side, the pivot element connects the mobile supports 22 of two adjacent glazed elements (no. 1 and no. 2) and (no. 3 and no. 4). For the glazed elements no. 1 and no. 4, the pivot on the fixed support side 22 is stationary. For the glazed elements no. 2 and no. 3, the pivot on the fixed support side is sliding in order to enable concertina-style opening.

The glazings 1 and 4 comprise two asymmetrical tempered soda-lime type glass sheets, whereas the glazings no. 2 and no. 3 comprise two tempered glass sheets of identical size. The glass sheets are covered on their internal face with a low-emissivity layer of TopN+T type from AGC. The internal space between the 2 glass sheets comprises argon as insulating gas. The opening of the doors may be automated. The tightness between the insulating glazings themselves and between the glazings and the fixed support is provided by transparent bulb seals. The vertical portion 25 of the spacer frame 50 separating the two glass sheets of each glazing 100 is a transparent polycarbonate spacer adhesively bonded to the glass sheets by means of a peripheral seal 27 which is a transparent double-sided adhesive tape of PSA type. The gastightness between the glass sheets may be provided by a transparent silicone glue 28 for the vertical portions and is provided by a mastic with a structural function 14 for the horizontal portions. The compartment 12 of the horizontal spacer 26 of the spacer frame 50 placed on the upper and lower edges of the insulating glazings 100 is an aluminum spacer comprising a molecular sieve such as a silica gel. A screenprinting 16 is placed on the horizontal edges of the insulating glazings 100.

The refrigerated chamber cabinet according to the invention makes it possible furthermore to improve the external esthetic appearance of these cabinets. Thus, the face of the cabinet that comprises the opening leaves may almost exclusively be made only from glass due to the absence of vertical frame jambs and it is possible to provide a small space between the opening leaves for the opening and closing of the cabinet without obstructing the visibility of the contents inside these cabinets.

The refrigerated chamber cabinet according to the invention makes it possible to meet the tightness criteria required for these types of cabinets, is easy to produce, this being achieved without increasing, or even by decreasing, its production cost.

The glazed element 100 according to the invention may be fitted to refrigerated chamber cabinets already in service in order to improve the thermal insulation performance thereof and to refine the visual access to the contents.

The invention is not limited to this particular type of embodiment and should be interpreted in a nonlimiting manner that encompasses any type of refrigerated chamber cabinet comprising at least one opening leaf that comprises at least one insulating glazing composed of at least one first glass sheet and one second glass sheet. Furthermore, a person skilled in the art will be able to add any variant to the insulating glazings according to the invention described in the preceding figures. For example, the insulating glazings may comprise several internal spaces each comprising an insulating gas (e.g. triple glazing), the glass sheets of the insulating glazing panels according to the invention may consist of any type of glass, may be surface-textured, may comprise coatings of any type intended to carry out any function, or may themselves consist of glazing panels laminated by means of plastic interlayers. A glazed element according to the invention may be used in any type of application such as the doors of refrigerated cabinets, freezers, glass walls (e.g. verandas, roof elements, etc.).

Measurement of the Tightness of a Multiple and/or Insulating Glazing a) Moisture Tightness The test consists in subjecting the glazing to a controlled atmosphere in which cycles of various temperatures and ambient humidities are alternated for a given time followed by a measurement of the amount of water that has penetrated inside the glazing. The test comprises two periods that spread over a total of 11 weeks:

- $1^{st}$ period of four weeks during which 67 thermal cycles of the same duration are alternated, each comprising 5 successive steps as follows:
  - step 1: linear temperature ramp from 20° C. to 0° C. with a gradient of 10° C./h and a linear humidity ramp from 60% relative humidity (RH) to 30% RH with a gradient of 15% RH/h;
  - step 2: hold for 1 h at 0° C. and 30% RH;
  - step 3: linear temperature ramp from 0° C. to 40° C. with a gradient of 10° C./h and a linear humidity ramp from 30% RH to 90% RH with a gradient of 15% RH/h;
  - step 4: hold at 40° C. and 90% RH for 1 h;
  - step 5: linear temperature ramp from 40° C. to 20° C. with a gradient of 10° C./h and a linear humidity ramp from 90% RH to 60% RH with a gradient of 15% RH/h;
- $2^{nd}$ period of 7 weeks of holding under a hot and highly humid constant atmosphere at 40° C. and 90% RH.

In order to measure the amount of water that has penetrated inside the glazing, the amount of water absorbed by the desiccative material located in the spacer(s) of the multiple glazing is measured. This measurement is carried out according to the method described in the EN 1279-2 standard in annex B or C. The results are expressed by the moisture penetration index I (as % of the amount of desiccative material consumed).

b) Gas Tightness

This is carried out according to the method described in the EN 1279-3 standard in annex C.

EXAMPLES

Example 1

In Accordance with the Invention

The procedure for assembling an insulating glazing according to the invention is the following.

The insulating glazing 100 is formed of two ground soda-lime-silica glass sheets 10 and 11 with a thickness of 4 mm and dimensions of 1600 mm×600 mm, a spacer frame 50 which comprises two PMMA transparent vertical spacers 25 (with the length of 1600 mm) and two horizontal spacers of the Technoform Glass Insulation® (TGI) brand with a length of 600 mm.

Each PMMA transparent spacer 25 has a thickness of 12 mm and a height of 10 mm. At each end, a 6.0 mm diameter hole is drilled in the direction normal to the thickness of the interlayer and at a distance equidistant from each edge of the spacer, in order to firmly attach the transparent spacer to the horizontal spacer. A 3M® VHB tape of transparent type is deposited on each side of the transparent spacers 25, in contact with the glass sheets 10 and 11.

Each horizontal spacer is composed of a profile comprising two compartments 12 and 17, which are separate and contiguous. The compartment 12 is hollow and has, as dimensions, a length of 580 mm and a thickness of 15 mm. the compartment 12 is filled with desiccant and each end is plugged by a butyl rubber pellet. The sides of the compartment 12 are also butyl rubber-coated. The compartment 17 is also hollow and has a thickness of 8 mm, a height of 7 mm and a length equal to the length of the compartment 12. The vertical spacers 25 and horizontal spacers 26 are attached by four screws 24. Each screw 24 is inserted into the compartment 17 via the holes drilled in the transparent spacers 25. The vertical edges of each glass sheet 10 and 11 are coated with a transparent 3M® primer. The spacer frame is pressed against the glass sheet 10. The second glass sheet 11 is deposited on the other side of the frame and pressed automatically by a vertical gas-pressing system. During this pressing step, an insulating gas, of argon type, is inserted into the insulating glazing in a proportion of from 90% to 98%. Any bubbling phenomenon at the tape/glass sheet 10 and 11 interface should be avoided. The horizontal edges of the insulating glazing are glued with DC 3362 silicon type glue 14. This glue glues the compartment 17.

The moisture tightness of the glazing of the glazed element in accordance with the invention measured by the index I as described above is typically less than 20%.

The argon gas tightness is itself less than 12%/year.

Example 2

Effect of the Primer

In order to characterize the advantageous effect of the primer, a test specimen of two glass sheets, one of which is coated with a low-emissivity layer, which are adhesively bonded to a double-sided tape (stack: glass/low-E layer/primer/double-sided tape/primer/glass) is conditioned in a hot and humid controlled atmosphere for a given duration after which the force necessary for completely separating the two sheets by tearing-off is measured. The same stack in which the primer layers were omitted was used as a reference for comparison.

The test specimen was produced from two small rectangular plates of soda-lime-silica float glass having a thickness of 4 mm and dimensions of 65 mm×25 mm. One of the two glasses was precoated with a TopN+T low-emissivity layer.

The double-sided tape used is the tape manufactured by the company 3M of 3M® VHB brand of transparent type. The transparent primer belongs to the family of silanes and also comes from the company 3M.

The glass surfaces to be adhesively bonded were first cleaned using isopropanol, then the primer was applied under an atmosphere of 25° C. and 50% RH. The primer was left to dry for 2 to 3 minutes before applying a 25×10 mm strip of tape transversely to one of the glass sheets so as to cover the entire width of the sheet in a central position thereof while carefully avoiding the formation and trapping of any air bubble between the tape and the glass sheet. The second glass sheet was then coated with the same primer and adhesively bonded in its central position to the other side of the tape already adhesively bonded to the first glass sheet so that the glass sheets together form an angle of 90°.

A reference test specimen was also produced in a manner similar to the first one, omitting however the application of a primer.

The two test specimens were then stored for 336 hours in a controlled atmosphere chamber at 70° C. and 100% RH.

The test specimens were then subjected to a mechanical test consisting in placing the two glass sheets of each test specimen under tension. The tension is exerted in a direction perpendicular to the surface of each of the 2 glass sheets under an atmosphere of 25° C. and 50% RH. The tensile strength needing to be applied to the glass sheets in order to give rise to the tearing-off and complete separation of the two sheets was measured. The same test was also applied to test specimens that had not been conditioned beforehand at 70° C. and 100% RH.

The results were the following:

| | Tear-off force, N | |
|---|---|---|
| Test specimen | Without conditioning | With conditioning |
| Without primer | >30 | 0 (adhesive failure) |
| With primer | >30 | >20 |

In all cases, the failure was of cohesive type within the material of the tape, except in the case of the sample without primer. The latter reveals a delamination phenomenon of the adhesive starting from the conditioning phase and gave rise to adhesive failure at the glass coated with the low-E layer/tape interface. Only the cohesive failure within the tape reflects a good attachment quality, the tensile strength necessary for the tearing-off making it possible to classify the stacks after aging according to the respective quality thereof, the best stacks requiring a greater tear-off force.

The invention claimed is:

1. An insulating glazed element comprising:

at least one insulating glazing comprising at least one first glass sheet and one second glass sheet which are joined together by a spacer frame which holds the first and second glass sheets at a certain distance from one another, the spacer frame extending along horizontal edges and vertical edges;

between the at least first and second glass sheets at least one internal space comprising an insulating gas, the internal space closed by at least one first peripheral seal and one second peripheral seal on horizontal edges and at least one peripheral seal on vertical edges, the peripheral seals being positioned around the internal space;

at least one framework that supports the at least one insulating glazing, the framework comprising:

a fixed support, and a mobile support connected to the fixed support that enables opening and/or closing of the glazed element, which mobile support lacks lateral sashes;

wherein, the spacer frame comprises at least two vertical spacers made of transparent resin and at least two horizontal spacers, the spacers being connected together to form the spacer frame, the horizontal spacers comprising a profile comprising at least one first compartment and one second compartment, which are separate and contiguous, the second compartment having a thickness less than or equal to a thickness of the first compartment, the at least one peripheral seal on the vertical edges is transparent, and the second compartment is at least in contact with the second peripheral seal.

2. The glazed element according to claim 1, wherein, the vertical spacers and horizontal spacers are connected together by at least one fastening means linking the vertical spacer and the horizontal spacer via the second compartment.

3. The glazed element according to claim 1, wherein, the second compartment of the horizontal spacer is juxtaposed with an external portion of the first compartment.

4. The glazed element according to claim 1, wherein, a thickness of the second compartment is at least 1 mm smaller relative to a thickness of the first compartment.

5. The glazed element according to claim 1, wherein, the first compartment and second compartment are hollow.

6. The glazed element according to claim 1, wherein, the first compartment and second compartment are solid.

7. The glazed element according to claim 1, further comprising at least one fastening means passing through the second peripheral seal connecting the second compartment to the mobile support of the framework and enabling attachment of the glazing to the mobile support of the framework.

8. The glazed element according to claim 1, wherein, the second peripheral seal is a mastic having a structural function, selected from silicone, polyurethane, and modified silicone.

9. The glazed element according to claim 1, further comprising a reinforcing profile inserted in the second peripheral seal.

10. The glazed element according to claim 7, wherein, the fastening means comprises a screw made of steel, galvanized steel, stainless steel or bronze.

11. The glazed element according to claim 1, wherein, the mobile support of the framework is connected to the fixed support by at least one articulation fastened to the horizontal portion of the mobile support of the framework.

12. The glazed element according to claim 1 further comprising a primer layer positioned between the seal and the glass sheet.

13. The glazed element according to claim 1, further comprising a primer layer positioned between the seal and the vertical spacer.

14. The glazed element according to claim 1, further comprising a primer layer positioned between the seal and the glass sheet and between the seal and the vertical spacer.

15. The glazed element according to claim 1, wherein the glazing has a heat transfer coefficient ranging from 0.3 to 1.8.

16. A refrigerated chamber cabinet comprising at least one glazed element according to claim 1.

17. A building window comprising at least one glazed element according to claim 1.

* * * * *